US006573441B2

(12) United States Patent
Norris, Jr.

(10) Patent No.: US 6,573,441 B2
(45) Date of Patent: Jun. 3, 2003

(54) DRUM PILLOW AND METHOD FOR USING SAME

(76) Inventor: Trent M. Norris, Jr., 48591 Hwy. 112, Port Angeles, WA (US) 98363

( * ) Notice: Subject to any disclaimer, the term of this patent is extended or adjusted under 35 U.S.C. 154(b) by 0 days.

(21) Appl. No.: 09/874,333

(22) Filed: Jun. 5, 2001

(65) Prior Publication Data

US 2002/0178893 A1 Dec. 5, 2002

(51) Int. Cl.[7] ..... G10D 13/02
(52) U.S. Cl. ..... 84/411 M; 84/411 R
(58) Field of Search ..... 84/411 M, 411 R, 84/422.1

(56) References Cited

U.S. PATENT DOCUMENTS 4,338,850 A 7/1982 Payson
4,567,807 A * 2/1986 Robinson ..... 84/411 M
4,589,323 A 5/1986 Belli et al.
5,088,376 A 2/1992 Crago et al.
5,107,741 A 4/1992 Beals et al.
5,233,898 A 8/1993 Montano
5,398,583 A * 3/1995 Cook ..... 84/411 M
6,043,420 A 3/2000 Arnold

* cited by examiner

*Primary Examiner*—Shih-Yung Hsieh
(74) *Attorney, Agent, or Firm*—Polly L. Oliver

(57) ABSTRACT

A drum pillow for use in a bass drum is disclosed herein. The drum pillow can be permanently or removably inserted into the interior of the bass drum shell. The preferred embodiment of the drum pillow is used to "deaden" or modify the sound, esp. overtones, of the bass drum during live performances, particularly when the drum is being struck by a typical foot-operated bass beater. An alternate embodiment is designed for use in studio recording sessions, where the situation calls for an even "deader" sound. Also disclosed herein is a method for using the drum pillow for the purposes described.

6 Claims, 4 Drawing Sheets

DRUM PILLOW AND METHOD FOR USING SAME

FIELD OF THE INVENTION

This invention relates generally to musical instrument accessories and more particularly to an insert for a bass drum that is used to "deaden" or modify the sound from the drum.

BACKGROUND OF THE FIELD

Many percussion instruments, particularly bass drums, have striking surfaces, i.e. drumheads, that vibrate to such an extent when struck that the sound produced thereby echoes and reverberates more than is desirable. Such overtones seriously reduce the quality of the sound from the drum. Consequently, in most situations, drummers would like to deaden, or dampen, the reverberation of the drumhead to produce a crisper, cleaner sound.

For years, drummers have been using various spontaneous methods to deaden the sound produced by the drums. One of these methods has been to toss loose rags or pillows inside the drum to absorb some of the sound overtones. Another method has been for the drummer to use his or her hand to directly dampen the vibrations of the drumhead. These methods have been used particularly with bass drums, which are large enough so that the inside of the drum can be easily accessed.

A bass drum is generally constructed of a cylindrical drum shell with two open ends, and at least one drumskin stretched across an open end forming a "drumhead." The circular edge of the drumhead therefore coincides with the circular edge of the drum shell. The drum is usually positioned on the floor so that the drumhead is generally orthogonal to the floor. A foot-operated "bass beater" strikes the drumhead at a strike point somewhat higher than the exact geometric center of the drumhead.

There have been some patented devices directed toward such "sound-deadening" in bass drums. The Montano U.S. Pat. No. 5,233,898 discloses and claims a drum damper comprising cushioning means and fastening means similar to the present invention. However, Montano's fastening means is a very specific arrangement of two straps using anchors fixedly attached to the interior of the drum shell designed for holding the cushion in compression against both the drum shell and the drumhead. In contrast, the present invention does not use straps at all because the presence of any straps or other non-absorbing material over the drum pillow serves to detract from the acoustic functionality of the drum pillow. Furthermore, Montano's device has a contact surface that specifically covers 25% or less of the drumhead area generally below the strike point and including only a small part of the edge of the drumhead. Because the majority of the higher sound harmonics are generated at the edge of the drumhead, it would be desirable to have pillow contact, and therefore damping action, all along the edge of the drumhead.

Crago et al., in U.S. Pat. No. 5,088,376, discloses an hourglass-shaped drum pillow that is compressed between the two drumheads of a bass drum. The Crago device is specifically designed to be used only in a drum with two drumheads, and again, the pillow surface covers only a drumhead area generally below the strike point and including only a small part of the edge of the drumhead.

Arnold, Payson, and Beals et al., respectively in U.S. Pat. Nos. 6,043,420, 4,338,850, and 5,107,741, disclose quite complicated dampening devices that are hinged or otherwise swing so as to make and break contact with the drumhead and thereby selectively deaden the vibrations from the drumhead at various times during play (similar to use of the drummer's hand). These devices are difficult for the drummer to control, because they require so much attention and manipulation, and therefore are inconsistent, ineffective and less than optimal.

SUMMARY OF THE INVENTION

Because of the dual nature of the uses of bass drums, the present invention has been developed in two specific embodiments, one for live performances and one for studio recording sessions. The embodiment for live performances has been chosen as the preferred embodiment. It is believed that the qualities and characteristics of the invention will be best understood in the context of this preferred embodiment.

The preferred embodiment of the present invention comprises two identical foam pieces that have been acoustically shaped and designed to provide optimal sound quality when properly positioned within the drum shell of a bass drum so as to contact the entire circular edge of the drumhead. The four sides will be referred to as the contact surface (positioned against the drumhead), the outer surface (positioned against the drum shell), the inner surface (directed toward the interior of the drum), and the free surface (directed away from the drumhead).

Because most drummers prefer a dampened sound resulting from drumhead coverage (drum pillow contact) of approximately 25 percent of the total area, the preferred embodiment of the present invention covers approximately 25 percent of the entire drumhead area. However, because the majority of the higher sound harmonics are generated at the edge of the drumhead (where the drumhead vibrations encounter the drum shell and bounce back), the preferred embodiment of the present invention of the permanent drum pillow has been designed to provide pillow contact, and therefore damping action, all along the circular edge of the drumhead. (Previous drum pillow designs have covered only a small part of the drumhead edge.) Furthermore, the preferred embodiment is provided in two pieces, an upper portion and a lower portion, so that any particular drummer can remove the upper portion if he or she prefers a more "lively" sound from the drum.

The contact surface of each piece is generally planar and is intended to impinge against the inside of the drumhead so as to contact approximately 12 percent of the drumhead area. The outer curve of the contact surface simply follows the curve of the bass drum shell. The inner curve of the contact surface has been chosen so as to provide the requisite contact surface area. Experiments have shown that a bevel around the outer edge of the contact surface improves the fit of the drum pillow within the drum shell, particularly for drum shells with edge lips; however, it is important to keep the bevel relatively small so as not to interfere with the sound absorption characteristics of the drum pillow.

In the preferred embodiment, one or more Velcro™ strips hold the pieces of the drum pillow in place inside the drum shell. Obviously, different types of hook-and-loop fasteners or even different types of fasteners, such as snaps, could be used to secure the drum pillow in place. However, it has been found that the Velcro™ strips are effective while having the benefit of being easy to install while maintaining the structural and acoustic integrity of the drum shell, e.g., without drilling holes or making permanent indentations in the drum shell. In the preferred embodiment, one portion of the Velcro™ fastener is applied to the interior of the drum shell and one portion is applied to the drum pillow. The drum pillow can therefore be made a temporary or a permanent installation, according to the particular drummer and situation.

Each of the two pieces of the preferred embodiment of the drum pillow is made of a single piece of dense foam to absorb higher harmonics, and each is covered with a rayon (or preferably silk) slipcover to further clean up and sharpen the sound, as well as to improve and customize the drum pillow's appearance. Other devices, such as many of the patented devices above-mentioned, are constructed of two or more pieces, only one of which is sound-absorbing. However, it has been found that having the entire drum pillow made of dense foam shaped into the desired form, while being simple to manufacture and manipulate, provides optimal sound-absorption properties.

During sound recording sessions, in contrast to live performances, drummers and producers typically prefer a much "deader" sound from bass drums. Therefore, it is desirable that significantly more than 25 percent of the drumhead area be dampened. A first alternate embodiment of the present invention comprises a single, three-sided foam piece that has been acoustically shaped and designed to provide optimal sound quality for sound recording purposes. The geometric parameters of the sides have been carefully chosen after much acoustic experimentation focusing on sound quality and simplicity of design. The three sides will be referred to as the contact surface (positioned against the drumhead), the bottom surface (positioned against the drum shell), and the top surface.

The contact surface is generally planar and is intended to impinge against the inside of the drumhead so as to contact approximately 50% of the drumhead area. Instead of covering the drumhead edge, this first alternate embodiment covers an area of the drumhead generally below the strike point of the bass-beater. It has been shown that for optimal acoustics, the upper point of the contact surface of the drum pillow must impinge the drumhead at approximately the strike point of the bass beater. The lower curve of the contact surface simply follows the curve of the bass drum shell. Experiments have shown that a bevel around the lower edge of the contact surface improves the fit of the drum pillow; however, it is important to keep the bevel relatively small so as not to interfere with the sound absorption characteristics of the drum pillow.

The bottom surface of this first alternate embodiment of the present invention of the drum pillow is designed to mate with and fit into the curve of the drum shell. The top surface and the bottom surface are both designed to smoothly taper the drum pillow from the contact surface at the drumhead which is being stricken to the far point at the opposite drumhead or the open end of the drum shell (depending on whether there is a second drum head on the particular bass drum).

DETAILED DESCRIPTION OF THE PREFERRED EMBODIMENT

Figure 1:
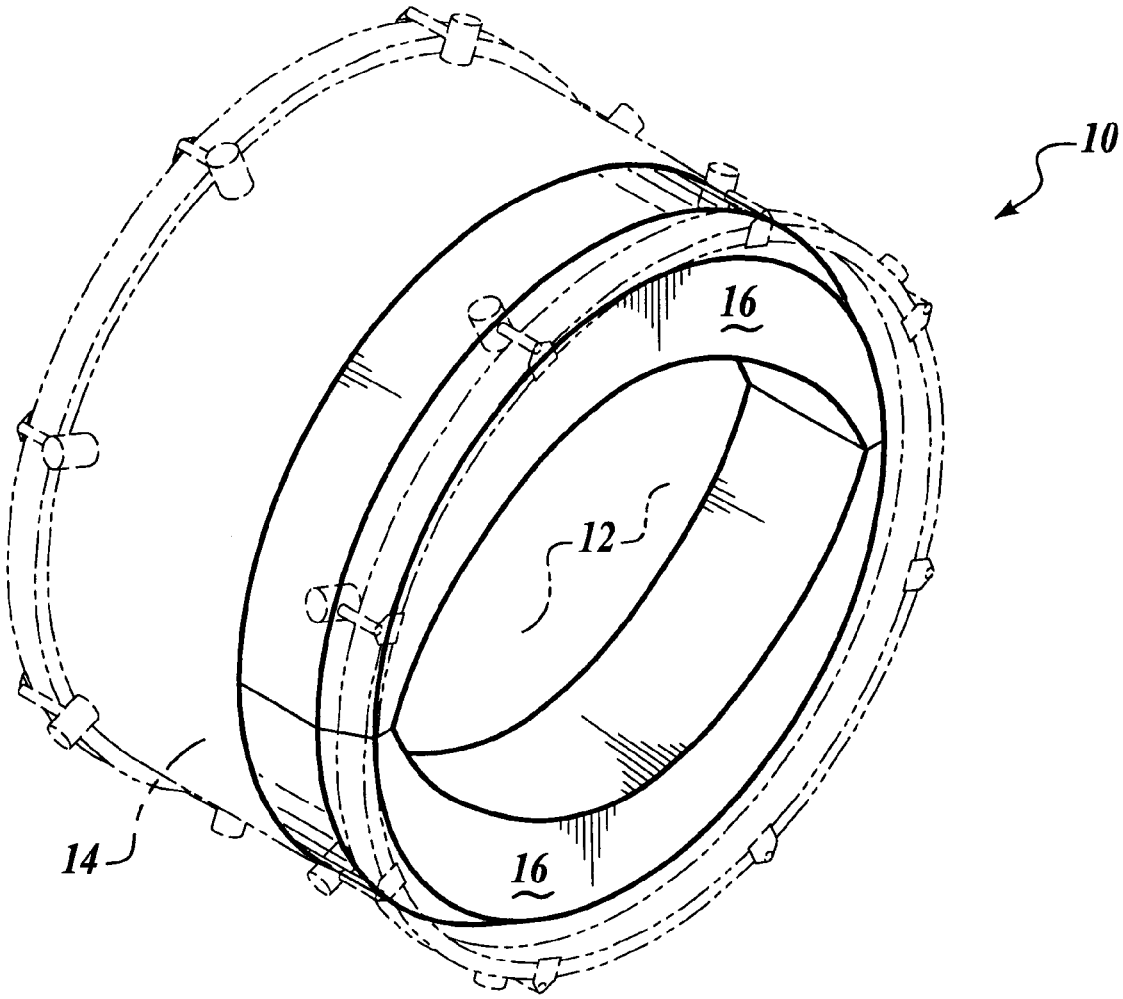
FIG. 1 is a perspective view of the preferred embodiment of the drum pillow installed in a bass drum as it might be for live performance purposes.

FIG. 1 shows the preferred embodiment of the drum pillow 10 installed in a bass drum, the drum being in the usual position for live performances, i.e., generally orthogonal to the floor. The bass drum comprises a drumhead 12 stretched across one open end of a generally cylindrical drum shell 14. The drum pillow 10 fits in the inside of the drum shell 14 such that the contact surface 16 impinges upon the drumhead 12. It is seen that the drum pillow 10 when properly installed impinges the entire drum shell edge.

Figure 2:
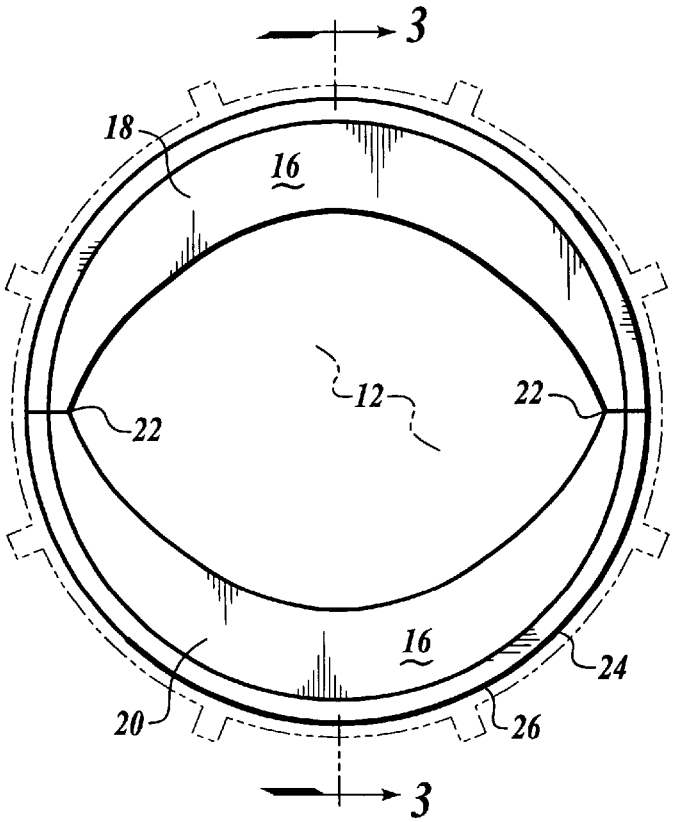
FIG. 2 is a front view of the preferred embodiment of the permanent drum pillow installed in a bass drum as it might be for live performance purposes.

FIG. 2 shows the contact surface 16 in more detail. The upper portion 18 and the lower portion 20 together cover approximately 20% of the area of the drumhead 12. (Alternatively, the drum pillow 10 could easily be provided as a single torus-shaped piece.) The mating surfaces 22 are typically located for convenience generally along the horizontal centerline of the drumhead 12 but could be located anywhere around the circumference, depending upon the installation of the drum pillow 10.

The bevel 24 of the preferred embodiment of the drum pillow 10 extends all along the outer curve 26 of the contact surface 16 and aids in the fit of the drum pillow 10 within the drum shell 14. Depending on the design of the particular bass drum and the desired acoustic characteristics of the drummer, there need not be a bevel at all. However, in the preferred embodiment, the bevel 24 measures approximately 0.75 inches along the contact surface 16 and approximately 1.50 inches along the outer surface 28 (best seen in FIG. 3), so that the overall slant of the bevel 24 is approximately 60 degrees from the contact surface 16. It is found that if the bevel 24 is much larger, then the acoustic characteristics of the drum pillow 10 begin to degrade.

Figure 3:
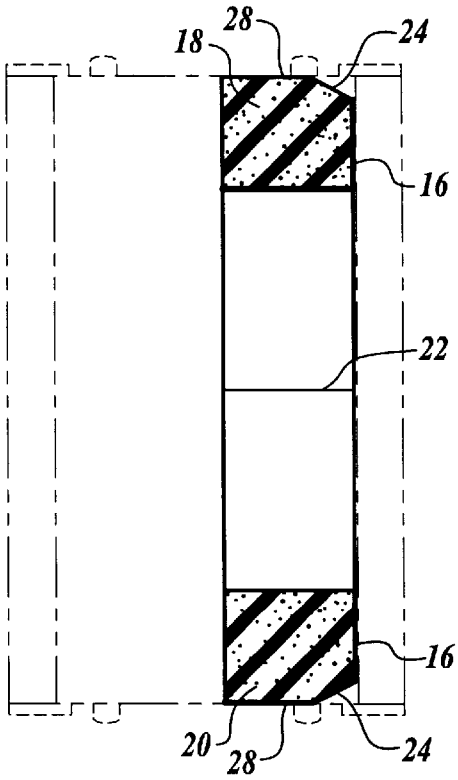
FIG. 3 is a sectional side view of the preferred embodiment of the permanent drum pillow.

In the side view of FIG. 3, the reader can see the bevel 24 in profile. (Because the two portions 18 and 20 are identical, the two portions are mirror images of each other, and the opposite side of this view is also a mirror image of this view.) FIG. 3 also illustrates how the outer surface 28 extends generally orthogonally from the contact surface 16 approximately 4 inches. A greater length would result in a more dampened sound and a lesser length would result in a less dampened sound. However, the preferred length of 4 inches results in an acoustically optimal sound for live performances. In the preferred embodiment, the upper portion 18 and the lower portion 20 are attached to each other at the mating points 22 by Velcro™ fasteners. Any other appropriate fastener may be used. Velcro™ fasteners are also used in the preferred embodiment to removably attach the portions 18, 20 of the drum pillow 10 to the interior of the drum shell 14.

Figure 4:
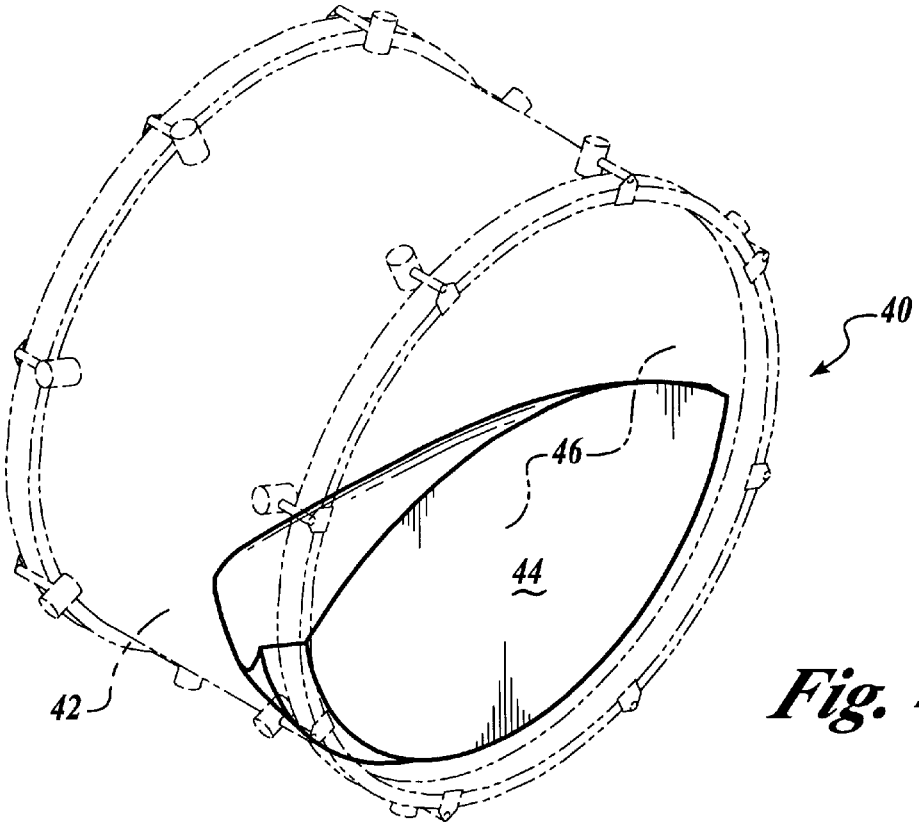
FIG. 4 is a perspective view of the first alternate embodiment of the permanent drum pillow installed in a bass drum as it might be for studio recording purposes.

FIG. 4 shows a first alternate embodiment of the drum pillow 40 installed in a bass drum, the drum being in the usual position for studio recording purposes, i.e., generally orthogonal to the floor. This perspective view shows how the drum pillow 40 fits in the inside of the drum shell 42 such that the contact surface 44 impinges upon the drumhead 46. Again, Velcro™ fasteners are used between the drum pillow 40 and the drum shell 42 to hold the drum pillow 40 in position.

Figure 5:
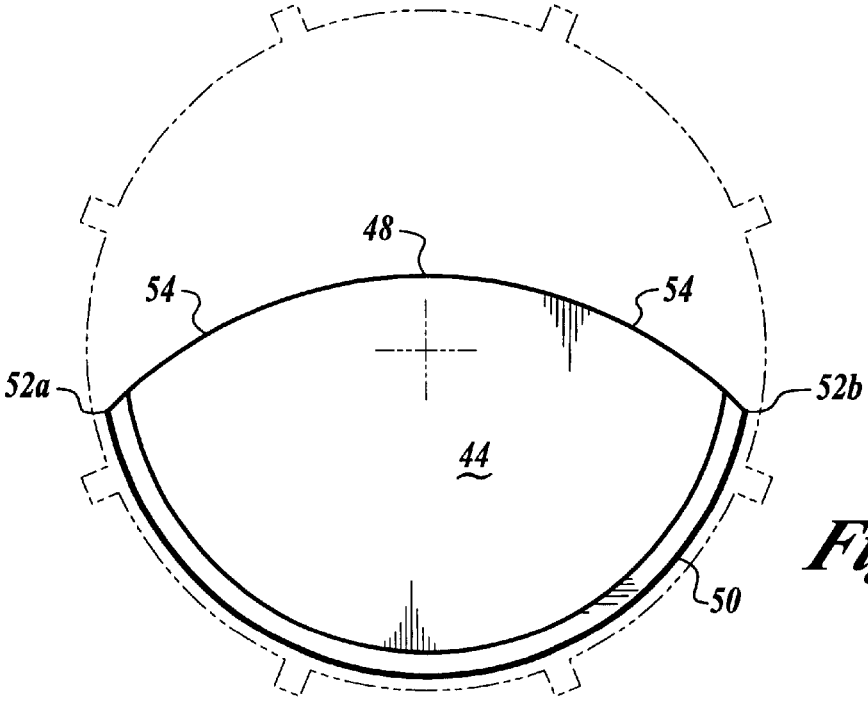
FIG. 5 is a front view of the first alternate embodiment of the permanent drum pillow.

FIG. 5 shows the contact surface 44 in more detail. A crosshair representing the geometric center of a normal drumhead is shown for the convenience of the reader. In most bass drums, the radius of the drumhead is approximately 10.5 inches and the strike point of the bass beater is approximately 1 inch above the geometric center of the drumhead, or 11.5 inches from the lower edge of the drumhead. Therefore, in the first alternate embodiment of the drum pillow 40, the apex 48 of the contact surface 44 is approximately 11.5 inches from the lower edge of the drumhead 46 and locates just above the center of the drumhead 46. The generally planar area of the contact surface 44 approximates a semicircle such that the lower curve 50 generally follows the curve of the drum shell 42 and terminates in the two endpoints 52*a* and 52*b*, typically located close to the horizontal diameter of the drumhead 46. The upper curve 54 extends in both directions from the apex 48 and slopes gradually down to the endpoints 52*a,b*. The endpoints 52*a,b* have been dropped down slightly below the horizontal so that the total area of the contact surface 44 will be approximately 50% of the area of the drumhead 46. The definition of the curve 54, and hence the locations of the endpoints 52*a,b*, is not as important as the location of the apex 48 and the total drumhead coverage of the contact surface 44.

Figure 6:
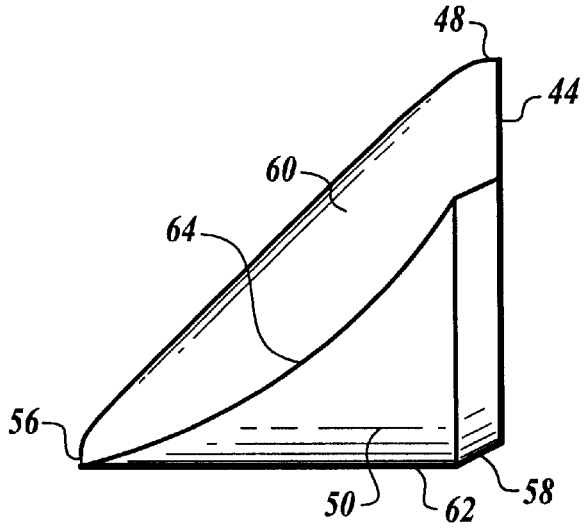
FIG. 6 is a side view of the first alternate embodiment of the permanent drum pillow.

As can be seen in FIG. 6, both the apex 48 and the far point 56 of the drum pillow 40 have been somewhat truncated, instead of forming sharp points. This truncation has been done for manufacturing purposes only because sharp edges in foam are difficult to shape and easily become deformed. It is not necessary for the performance of the drum pillow 40 that these two sharp points be truncated; and indeed too much of a truncation will adversely affect the acoustic characteristics of the drum pillow 40. However, the truncation of the far point 56 may have another beneficial effect. If there is a second drumhead on the drum shell such that the far point 56 impinges upon this second drumhead, the second drumhead will be somewhat dampened as well.

In addition, FIG. 6 shows how the first alternate embodiment also includes a bevel 58. (Because the drum pillow 40 is symmetrical, the opposite side is a mirror image of the side shown.) FIG. 6 also illustrates how the bottom surface 62 is bounded by the lower curve 50 of the contact surface 44 and the edge 64 between the bottom surface 62 and the top surface 60.

Figure 7:
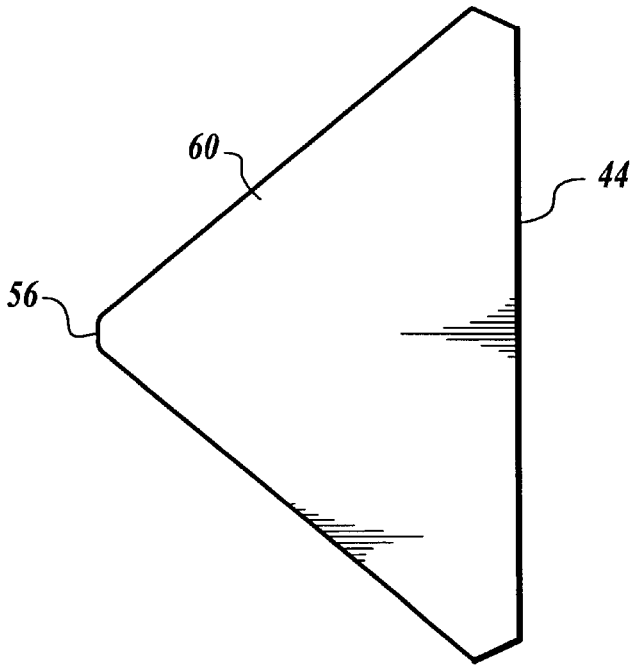
FIG. 7 is a top view of the first alternate embodiment of the permanent drum pillow.

FIGS. 6 and 7 considered together show how the top and bottom surfaces 60 and 62 taper from the contact surface 44 toward the far point 56. The taper of the top surface is shaped not only to smoothly connect the contact surface to the bottom surface but also to accommodate a microphone within the drum shell. The rounded shape of the top surface provides better acoustics within the drum shell than a flat or angular surface would do. The overall length of the drum pillow 40 in the first alternate embodiment from the contact surface 44 to the far point 56 is approximately 14 inches, which is the usual length of a bass drum shell. The taper can be made more or less severe so that the overall length of the drum pillow will be more or less than 14 inches, according to the specific design and acoustic preferences of the drummer. Different tapering lengths will obviously give different acoustic properties; however, the current design of the first alternate embodiment was chosen to provide optimal acoustics for studio recording purposes.

What is claimed is:

1. A drum pillow, for use within a bass drum having a generally cylindrical drum shell defining an interior with an inside diameter and an axis therethrough and at least one drumhead fixed generally orthogonally to said axis on an end of said shell, comprising:

a first crescent-shaped portion being defined roughly by an outer curved surface having an outer diameter, an inner curved surface having an inner diameter, and two horns, and said first crescent-shaped portion having a generally uniform thickness, thickness being measured in a direction perpendicular to said diameters, and a plane of symmetry, said plane of symmetry being oriented generally orthogonally to said curved surfaces, said outer diameter being approximately equal to the inside diameter of the drum shell, said inner diameter being such that the crescent tapers outwardly in both directions from said plane of symmetry towards the horns of the crescent, and said horns of the crescent being truncated such that they terminate in roughly flat mating surfaces which are generally orthogonal to said plane of symmetry;

a second crescent-shaped portion being defined roughly by an outer curved surface having an outer diameter, an inner curved surface having an inner diameter, and two horns, and said second crescent-shaped portion having a generally uniform thickness, thickness being measured in a direction perpendicular to said diameters, and a plane of symmetry, said plane of symmetry being oriented generally orthogonally to said curved surfaces, said outer diameter being approximately equal to the inside diameter of the drum shell, said inner diameter being such that the crescent tapers outwardly in both directions from said plane of symmetry towards the horns of the crescent, and said horns of the crescent being truncated such that they terminate in roughly flat mating surfaces which are generally orthogonal to said plane of symmetry, said second crescent-shaped portion being removably mated with said first crescent-shaped portion at the mating surfaces; and fastening means for attaching the first and second portions of the drum pillow to the interior of the drum shell, said fastening means comprising hook and loop fasteners.

2. The drum pillow of claim 1 wherein the first and second portions further define a bevel along the outer surfaces of said portions.

3. The drum pillow of claim 1 wherein the outer diameters of the first and second portions measure approximately 21.5 inches, the inner diameters of the first and second portions measure approximately 24.5 inches, and the uniform thicknesses of the first and second portion measure approximately 4 inches.

4. The drum pillow of claim 1 further comprising hook-and-loop fastener strips on the mating surfaces of the first and second portions.

5. A method for using a drum pillow comprising at least one portion which is beveled on an outer edge and fastened to the inside of the drum shell with hook and loop fasteners to dampen the vibrations in a bass drum which has been placed on the floor, such bass drum comprising a generally cylindrical drum shell defining an interior and a drumhead fixed on one end of said shell, when using a typical foot-operated bass beater to strike the drumhead at a predetermined strike point, comprising the steps of:

placing the bass drum on the floor such that the drumhead is generally orthogonal to the floor;

placing the bass beater such that the strike point is slightly above the geometric center of the drumhead;

inserting the drum pillow within the interior of the drum shell such that the beveled edge of the drum pillow is adjacent the drumhead;

fastening the drum pillow to the inside of the drum shell with the hook and loop fasteners;

operating the bass beater so as to strike the drumhead.

6. The method of claim 5 wherein the drum pillow comprises a single portion of dense foam fastened inside the drum shell such that the drum pillow contacts approximately 50 percent of the drumhead area and the drum pillow extends from the edge of the drumhead to the bass beater strike point.

* * * * *